United States Patent [19]

Lefever et al.

[11] 4,068,480

[45] Jan. 17, 1978

[54] LIQUID STORAGE SYSTEMS

[76] Inventor: Kenneth Winans Lefever, Rte. 1, Box 134, Waterford, Va. 22901; John James Gallagher, 171 Williams Drive, Annapolis, Md. 21401

[21] Appl. No.: 631,686

[22] Filed: Nov. 13, 1975

[51] Int. Cl.[2] ..... B65D 25/24

[52] U.S. Cl. ..... 61/0.5; 220/18

[58] Field of Search ..... 61/0.5, 1 R; 220/13, 220/18, 26, 9 LG

[56] References Cited

U.S. PATENT DOCUMENTS

| | | | |
|---|---|---|---|
| 2,211,958 | 8/1940 | Mahaffey | 61/0.5 UX |
| 2,655,888 | 10/1953 | Alcorn | 61/0.5 UX |
| 3,096,902 | 7/1963 | Schroeder | 220/18 |
| 3,516,568 | 6/1970 | Fish | 220/18 |
| 3,537,267 | 11/1970 | Webb | 61/0.5 |
| 3,675,427 | 7/1972 | Hix | 61/0.5 |
| 3,727,418 | 4/1973 | Glazier | 61/0.5 X |
| 3,777,497 | 12/1973 | Edwards | 220/18 X |
| 3,943,721 | 3/1976 | Azalbert et al. | 61/0.5 |

*Primary Examiner*—Dennis L. Taylor

[57] ABSTRACT

A system for storing a first liquid isolated from the ambient environment by a second liquid of different density including outer walls forming a chamber, a flexible membrane in the chamber to form an inner chamber spaced from the chamber for containing the first liquid, means to maintain spaced relation between the chambers when full, and the second liquid filling the space between the chamber walls and the membrane.

17 Claims, 6 Drawing Figures

LIQUID STORAGE SYSTEMS

BACKGROUND OF THE INVENTION

This invention relates generally to systems for storing liquids and more particularly to a petroleum storage structure utilizing earthen walls and floor for the major portion of the structure.

Conventional petroleum storage usually involves fabricated metal storage tanks. Such storage of petroleum is feasible where the storage is relatively temporary such as where the petroleum stored is in transit either for refining or for distribution by tanker, barge or ground transport.

Since the "Energy Crisis" incurred by the producing countries' oil boycott of 1974, there has been substantial concern that future crises will be precipitated by similar boycotts by oil producing nations. To avoid this President Ford has required that a substantial amount of crude oil be placed in storage in this country. This requirement has imposed a great deal of pressure to develop suitable storage capability for this inventory of petroleum. Among the suggested storage receivers are the salt domes which occur in certain parts of the country. The salt domes, although more economical then fabricated tanks, do have limitations in that their availability is restricted to certain geographical locations and do impose some pumping costs for injecting and recovering the petroleum from the formations.

Ground storage systems of the type of this invention have been generally described in the prior art, such, for example, as in the patents to Fish (U.S. Pat. No. 3,516,568), Prins (U.S. Pat. No. 3,052,380) and Webb (3,537,267); however, there are certain limitations in the prior art devices which are overcome by the present invention. A prime distinction of the present invention overcoming shortcomings of the prior art devices lies in the fact that petroleum is less dense than water. In a system where water encloses a petroleum product, as in the aforedescribed systems, the free surface of the water will be below that of the free surface of the petroleum. Utilizing a flexible liner between the water and the petroleum results in a differential unsupported area of contained petroleum. The lighter petroleum will also tend to spread as it is "buoyed" up by the water, thereby tending to spread the flexible liner radially, thereby bringing that liner into contact with the surface of the containing system. These problems are not dealt with in Fish; however, part of the problem is dealt with in Webb by utilizing containing liquids of different densities to compensate for the differential level. A liquid different than water to obtain this different density would be considered a pollutant in itself in that if it escaped into the ground water of the surrounding terrain, it would be an unnatural and therefore polluting substance thereby obviating one of the purposes of the invention.

The present invention overcomes this disadvantage by providing a three-phase system comprising petroleum enclosed in a flexible liner, a water jacket surrounding the bottom and sides of the petroleum, means to maintain the liner spaced from the water jacket container, and means to apply a load to the top surface of the petroleum to equalize the heights of the surface of the petroleum and the surrounding water.

SUMMARY OF THE INVENTION

This invention relates to a system for storage of petroleum which affords economical storage while not imposing geographical limitations on the storage area.

The invention also offers a system for storing petroleum which can be located in abandoned strip mine areas, thereby providing an additional benefit of curing the blight and eyesore resulting from unfilled strip-mined terrain.

The invention provides a petroleum storage system which is environmentally safe by furnishing a petroleum having water on the bottom and sides thereof and which is provided with means to maintain the vapor space thereabove under positive pressure.

In a preferred embodiment, the invention comprised earthen side and bottom walls defining a chamber, a flexible liner disposed in the chamber contiguous with the side and bottom walls thereof, petroleum stored in the liner, water disposed between the liner and the chamber walls, a top cover over the chamber and connected to the liner to form a closure for the chamber and a closed petroleum containing inner chamber with the liner, means to maintain the liner and chamber walls spaced from one another, means to restrict the upper level of water and a means to apply a load to the upper surface of the petroleum in the inner chamber to equalize the liquid level height between the petroleum and the water.

These and other objects and advantages of the present invention will become better understood to those skilled in the art by reference to the following detailed description when viewed in light of the present invention wherein like components throughout the figures are indicated by like numerals and wherein:

DESCRIPTION OF PREFERRED EMBODIMENTS

In FIGS. 1 through 4 the embodiments illustrated to maintain this spaced relation by providing an inner liner with adequate hoop strength to resist radial expansion thereof. As will be described below, the embodiment of FIG. 5 accomplished the same objective by other means. Since the liquid stored in the inner chamber formed by the flexible liner of this invention is lighter than water, the resultant buoyant forces acting on this liquid will tend to cause it to flatten and spread radially toward the outer chamber. Means must be provided to restrict this to keep adequate spacing between the chambers.

Figure 1:
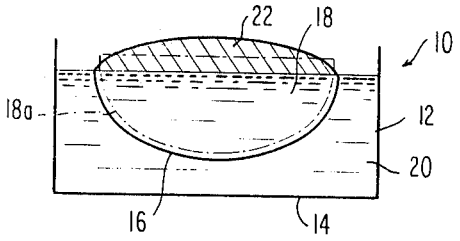
FIG. 1 is a schematic view in elevation showing an embodiment of the invention.

In FIG. 1 a system in accordance with the invention is illustrated schematically and consists of an outer chamber shown generally at 10 formed by liquid-impervious side walls 12 and bottom wall 14. A flexible, liquid-impervious membrane 16 is disposed in the chamber 10 in spaced relationship to the walls 12 and 14 and contains a liquid 18 of a specific density. The space between the membrane 16 and the outer chamber 10 contains another liquid 20 of greater density than the liquid 18. As described above, one embodiment of this invention is directed to the storage of petroleum in an environmentally safe manner by isolating the petroleum in a water jacket; however, it is contemplated that the invention may be applied to the similar storage of any liquids of different densities for any purpose such, for example, as wherein the temperature of the insulated liquid may be controlled by use of the isolating liquid as an insulating and/or heat applying or removing medium. It should be understood that, although specifically described as applied to the petroleum-water storage embodiment hereinafter described, the invention is applicable to systems involving any liquids of different densities.

In a petroleum-water system, in accordance with the invention, the petroleum is less dense than water and therefore comprises the liquid 18 while water comprises the liquid 20. Because of the density differential, the membrane 16 containing the less dense petroleum 18 would normally assume a position extending above the surface of the surrounding water 20 as is indicated by the dotted line 18*a*. This would result in an area around the upper periphery of the membrane which would be unsupported by the water 20 and would, if not otherwise supported by mechanical means, expand toward the wall 2 until it ruptured or came in contact with the wall 12 thereby obviating the benefits of the invention.

In order to avoid the above condition, this invention provides means to load the less dense liquid to at least equalize the liquid level thereof with the liquid level of the water 20. The loading means is represented by the area 22 in FIG. 1 which may comprise a solid or, as described in greater detail below, a liquid-solid system or gas pressure imposed on the surface of the petroleum.

What is provided in the generally described embodiment then is a storage system wherein petroleum is contained in the membrane 16 and is surrounded on the sides and bottom by water 20 in the outer chamber 10 so that any leaking from or failure of the membrane 16 will not only be contained in the isolating water jacket but will serve as a tell-tale on the surface of the water jacket to indicate the leaking condition. An automatic petroleum detector such as one sensing the difference in electrical conductivity between oil and water, as are generally available commercially, may be installed at the surface of the water 20 to provide a signal in the event of a leak. In the large storage systems for which this invention is intended, it is conceivable that repairs to the membrane can be made by divers entering the water jacket through manholes provided for that purpose. To facilitate location of the leak, radially extending barriers could be inserted between the membrane 16 and the outer chamber 10 at least at the surface of the water 20 to confine the leak indication to the segment of the membrane in which it occurs.

From the general embodiment described hereinabove, it can also be seen that, with suitable pumps and piping, water can be supplied to the outer chamber 10 as petroleum is discharged from the membrane 16 or vice versa to maintain the surface levels substantially constant in the event the load 22 is applied as a solid.

Figure 2:
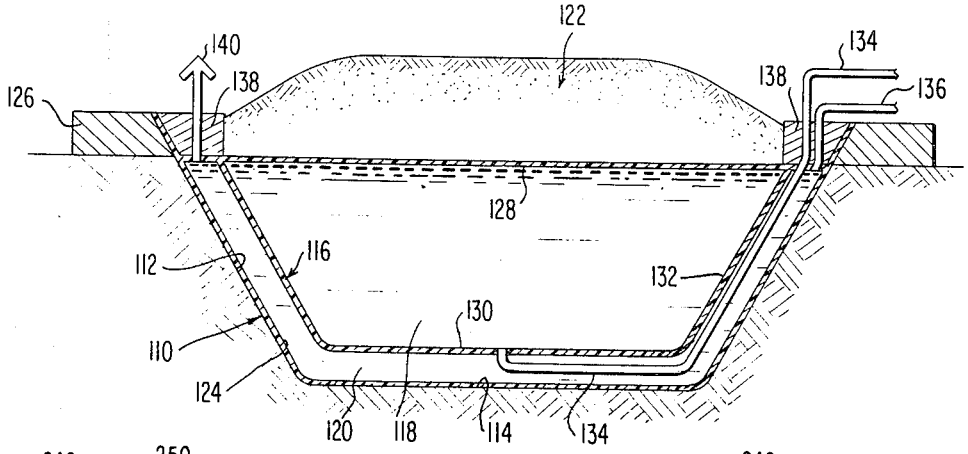
FIG. 2 is a sectional elevation of the embodiment of the invention shown in FIG. 1.
Figure 3:
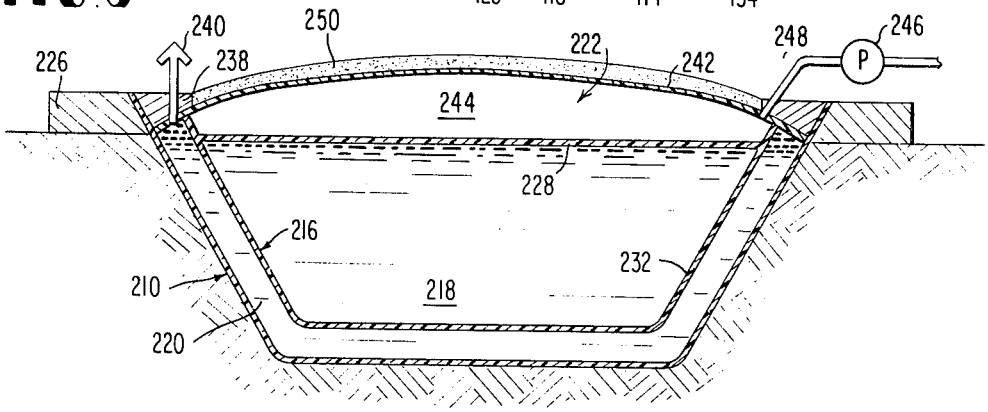
FIG. 3 is a sectional elevation of another embodiment in accordance with the invention.
Figure 4:
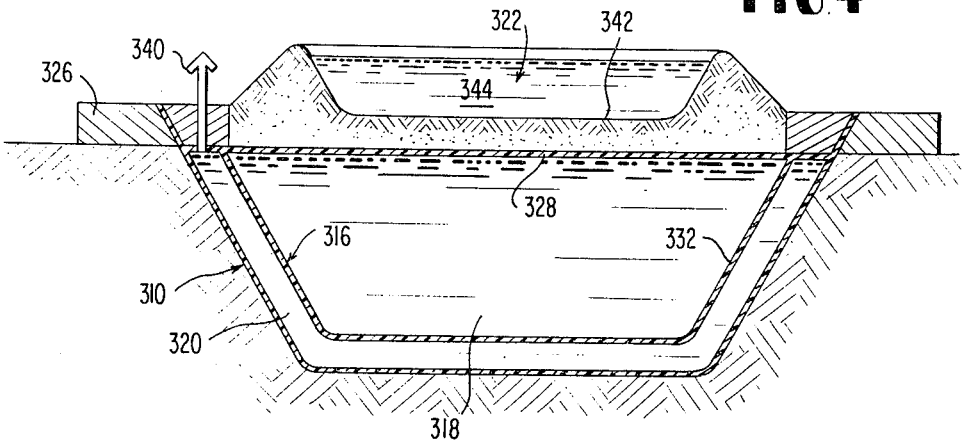
FIG. 4 is a sectional elevation of another embodiment in accordance with the invention.

In the embodiments of FIGS. 2, 3 and 4, components of the system corresponding to like components of the system described in FIG. 1 are indicated by like numerals of the succeeding higher order in each embodiment.

In FIG. 2, the outer chamber 110 comprises an excavation in the ground with sloping side walls 112 and a bottom wall 114 forming a recess. A water-impervious lining 124 is disposed on the walls 112 and 114 to provide a watertight barrier therefore. In soil conditions where the ground is normally substantially water-impermeable, such as in clay or rock areas, where the ground can be compacted to be substantially water-impermeable, the lining 124 may be omitted. If there is some leakage and water is readily and economically available, a water makeup system can be provided to supply water to replace the leakage experienced.

The lining 124 may comprise a coating imparted to the walls 112 and 114 or may consist of a separate flexible membrane formed or deformable to fit the contour of the walls 112 and 114. This membrane, as well as the membranes to be described hereinbelow, may be of any flexible material compatible with the environments specified, such, for example, as plain or reinforced vinyl sheeting or the like. The lining 124 terminates at a raised annular embankment or collar 126 surrounding the recess forming the outer chamber 110. A diaphragm 128 covers the recess 110 extending in sealing relationship from the side walls 112.

Disposed within the outer chamber 110 and formed generally to conform to the configuration of the walls 112 and 114 is a flexible membrane 116 having bottom and side walls 130 and 132 connected to the membrane 128 and sized to maintain a spaced relationship to the corresponding walls 112 and 114 of the outer chamber. The space between the outer chamber walls 112 and 114 and the membrane walls 132 and 130 is filled with water 120 while the membrane is filled with petroleum 118. Piping to accomodate filling and draining of the liquids consists of a petroleum line 134 communicative with the contents of the membrane 116 through the bottom wall 130 thereof and extending to the surface through the water space to a pump or petroleum supply. The line 134 can be made flexible or hinged to follow the motion of the bottom wall 130 as petroleum is loaded or discharged from the outer chamber 110 through a water line 136 communicative therewith and connected to a source of water pressure or supply. Discharge pressure for the petroleum 118 could be derived from incoming water pressure through the line 136 if so desired.

The space above the water 120 is confined by an overburden 138 which serves to positively contain the water and to protect that portion of the membrane 128 over the water 120. A vent 140 is disposed through the fill to accomodate minor variations in the level of the water 120 due to temperature, pressure or content changes. The vent 140 also serves as a standpipe to maintain back pressure on the water and to accomodate changes in pressure due to rain or snow loading.

As was stated in the embodiment of FIG. 1, because of the greater specific gravity of the water 120 over that of the petroleum 118, a load on the petroleum is required in order that the levels of the two liquids remain substantially equal. This is accomplished, in the embodiment of FIG. 2, by a solid earthen backfill 122 disposed on the portion of the membrane 128 spanning the petroleum 118. The amount of backfill applied should be that which, when added to the density differential or buoyant force on the petroleum, will render the membrane neutrally buoyant. The backfill, in addition to its density differential compensating purpose, also serves as a protection for the petroleum and an environmentally compatible cover for the system.

In FIG. 3 a system similar to that described in FIG. 2 but having a different means for imposing a load on the petroleum is described. In this figure, components corresponding to like components of the preceding figures are indicated by like numerals of the next higher order. The load, generally indicated at 222, is imposed on the membrane 228 by providing a gas-impermeable membrane 242 connected to the walls 212 to cover the membrane 228 and form a gas spaced therebetween. If desired, the membrane 228 could be omitted in this version. A source of gas pressure 246 is communicative with the space 244 through a gas line 248 to provide means to pressure the space 244 to a sufficient amount to render the membrane 216 and oil 218 neutrally buoyant in the water 220 in a manner similar to that described for the solid loading system of FIG. 2. The gas used for pressurization may be of any type compatible with the materials and is preferably, particularly if the top membrane 228 is omitted, inert such, for example, as nitrogen or the like. Protective backfill 250 is added to upper surface of membrane 242 to provide a cover therefore.

In the embodiment of FIG. 4, again, components corresponding to like components of the preceding figures are indicated by like numerals of the next higher order. In this embodiment, the load, indicated generally at 322, comprises a basin 342 formed in a backfill and filled with a liquid 344 such as water or the like. As in the embodiment of FIGS. 2 and 3, the total weight or load imposed by the water and fill should be enough to render the membrane 316 and petroleum 318 neutrally buoyant in the water 320. This embodiment yields an additional benefit in that the water in the basin can be utilized to supply water to the outer chamber 310 in the event of leakage of water therefrom or withdrawal of petroleum from the system. The presence of water over the storage area renders the system environmentally pleasing and provides water for inundating the area or for fighting fire in the event of a conflagration.

Figure 5:
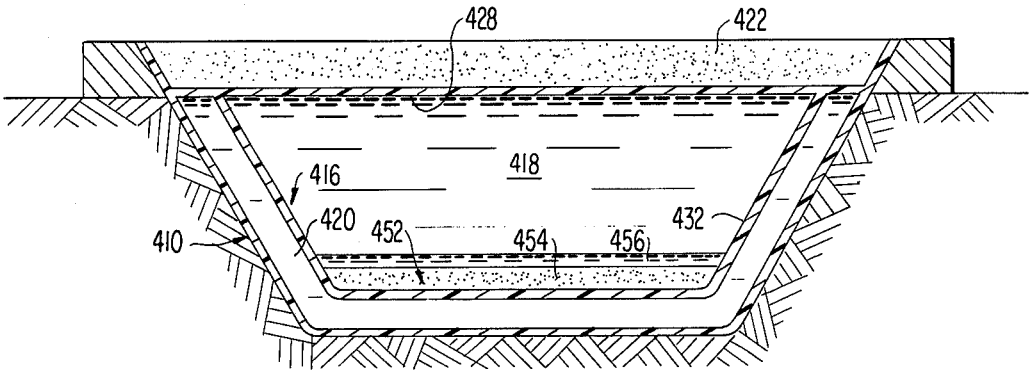
FIG. 5 is a sectional elevation of yet another embodiment in accordance with the invention.

As in the aforedescribed embodiments, components of the embodiment of FIG. 5 corresponding to those of the previous embodiments are indicated by like numerals of the next higher order. In the embodiment of FIG. 5, the hoop strength of the membrane 416 is insufficient to restrain the tendency of the petroleum 418 to expand radially under the influence of the buoyant force of the water 420 to press the membrane against the walls of the outer chamber 410. Other means must therefore be provided to restrain this outward radial expansion of the sidewalls 432 of the membrane 416. In the absence of sufficient hoop strength, these means must, with a flexible membrane, comprise means to apply a downward restraint to constrain the side walls 432 in tension. Such means could comprise tension anchors from the base of the membrane 416 to the outer chamber 410, compression spacers between the overburden 422 and the bottom of the membrane or, as in the embodiment illustrated in FIG. 5, a dead load 452 in the bottom of the membrane 416. This dead load could comprise any material of sufficient weight to counter the differential density between the water and oil causing the tendency to spread the membrane 416 radially such, for example, a sand layer 454 spread evenly across the bottom of the membrane. In the event sand or some other particulate is used, an intermediate layer of water 456 will maintain segregation between the oil and sand to preclude mixing thereof.

Figure 6:
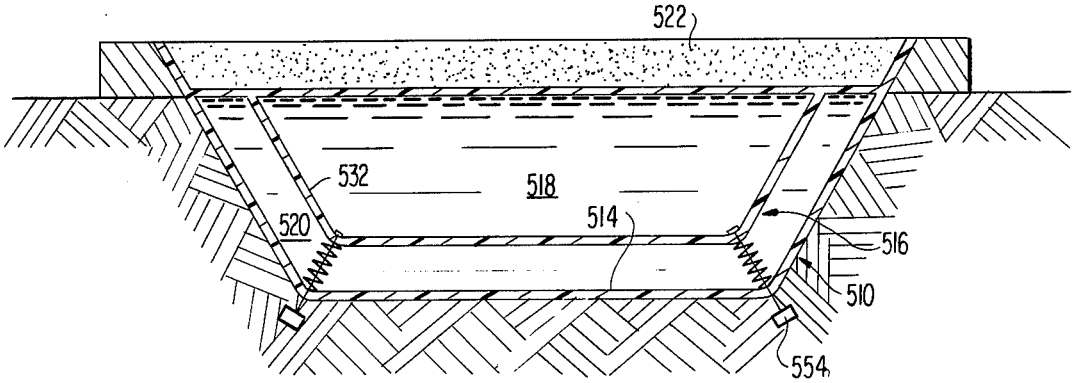
FIG. 6 is still another embodiment in accordance with the invention.

FIG. 6 illustrates an embodiment similar to FIG. 5 in which the downward load on the membrane 516 is imposed by spring tension members 552 attached to the membrane bottom and to anchors 554 embedded in the outer chamber bottom wall 514. In both of the latter described embodiments the overburden 422 and 522 need only be sufficient to protect the top walls 428 and 528 of the membrane since the buoyancy balancing function of the overburden of the previous embodiments is accomplished by the dead load 454 and spring tension members 552 of FIGS. 4 and 5.

The invention, as described above, provides a safe, environmentally compatible system for storing liquid hydrocarbons. The vapor space above the liquid is rendered safe by increased vapor pressure in that space. The system is suitable for installation in all terrains, even in areas of high water table, since the water jacketing the system will be readily accomodated in such locations. Where it is desired to limit exposure of the flexible membrane to the stored hydrocarbon, a water base may be injected in the inner chamber prior to filling with the hydrocarbon if so desired.

Where used herein the term "density" is intended to mean weight per unit volume of the substance referred to.

What has been set forth above is intended as exemplary of teachings in accordance with the invention to aid those skilled in the art in the practice thereof.

What is new and desired to be protected by Letters Patent of the United States is:

1. A system for storing liquids of different densities comprising;
   walls defining a liquid-impervious outer chamber;
   a flexible liquid-impervious membrane disposed in spaced relation to said walls to define an inner chamber containing the less dense of said liquids;
   the more dense of said liquids filling the space between said chambers;
   means to adjust the level of the less dense of said liquids to a level substantially equal to that of the more dense of said liquids;
   means to overcome the density differential between said liquids such that the surface level of the more dense of said liquids is at least substantially equal to that of said liquids.

2. A system in accordance with claim 1 wherein said means to adjust the level of said liquids comprises means associated with said inner chamber to overcome the idensity differential between said liquids such that the surface level of the more dense of said liquids is at least substantially equal to that of the less dense of said liquids.

3. A system in accordance with claim 1 wherein said means to restrict includes a standpipe communicative with the more dense of said liquids.

4. A system in accordance with claim 1 wherein said means to overcome the density differential between said liquids comprises means to load the less dense of said liquids.

5. A system in accordance with claim 4 wherein said means to load the less dense of said liquids comprises a mass of material imposed on the upper surface of the less dense of said liquids.

6. A system in accordance with claim 4 wherein said mass comprises a solid.

7. A system in accordance with claim 4 wherein said mass includes a liquid.

8. A system in accordance with claim 4 wherein said means to load the less dense of said liquids comprises means to impose gas pressure against the surface of the less dense of said liquids.

9. A system in accordance with claim 1 wherein said walls comprise earth.

10. A system in accordance with claim 9 wherein said walls are rendered liquid-impervious by coating with a sealant.

11. A system in accordance with claim 9 wherein said walls are rendered liquid-impervious by lining with a second flexible liquid-impervious membrane.

12. A system in accordance with claim 4 wherein said means to load the less dense of said liquids imparts a pressure to the surface thereof greater than vapor pressure thereof.

13. A system in accordance with claim 8 wherein said means to overcome the density differential between said liquids comprises means to load said membrane downwardly.

14. A system in accordance with claim 13 wherein said means to load said membrane comprises a dead load within said membrane.

15. A system in accordance with claim 13 wherein said means to load said membrane comprises tension means between the bottom of said membrane and said chamber.

16. A system in accordance with claim 15 wherein said tension means includes a spring load.

17. A system in accordance with claim 1 wherein said means to adjust the level of said liquids comprises means to restrict upward movement of the surface of the more dense of said liquids to a level at most substantially equal to that of the less dense of said liquids.

* * * * *